US009628899B2

(12) United States Patent
Huang et al.

(10) Patent No.: US 9,628,899 B2
(45) Date of Patent: Apr. 18, 2017

(54) PIEZOELECTRIC CERAMIC SPEAKER AND DUAL-BAND EARPHONE HAVING THEREOF

(71) Applicant: Jetvox Acoustic Corp., Taoyuan (TW)

(72) Inventors: Ying-Shih Huang, Taoyuan (TW); To-Teng Huang, Taoyuan (TW)

(73) Assignee: Jetvox Acoustic Corp., Taoyuan City (TW)

( * ) Notice: Subject to any disclaimer, the term of this patent is extended or adjusted under 35 U.S.C. 154(b) by 0 days.

(21) Appl. No.: 14/833,750

(22) Filed: Aug. 24, 2015

(65) Prior Publication Data

US 2016/0360310 A1 Dec. 8, 2016

(30) Foreign Application Priority Data

Jun. 2, 2015 (TW) ..... 104208756 U

(51) Int. Cl.
*H04R 1/24* (2006.01)
*H04R 17/00* (2006.01)
*H04R 1/10* (2006.01)

(52) U.S. Cl.
CPC ..... *H04R 1/24* (2013.01); *H04R 1/10* (2013.01); *H04R 17/00* (2013.01); *H04R 2307/023* (2013.01)

(58) Field of Classification Search
CPC ... H04R 1/24; H04R 1/26; H04R 1/28; H04R 1/1016; H04R 1/1075; H04R 17/00
See application file for complete search history.

(56) References Cited

U.S. PATENT DOCUMENTS 5,430,803 A * 7/1995 Kimura ..... H04R 1/46 381/190
2013/0223657 A1* 8/2013 Onishi ..... G01S 7/521 381/190
2015/0373460 A1* 12/2015 Huang ..... H04R 1/02 381/190
2016/0119721 A1* 4/2016 Doshida ..... H04R 1/1075 381/190
2016/0127820 A1* 5/2016 Huang ..... H04R 1/10 381/380
2016/0277823 A1* 9/2016 Huang ..... H04R 1/1016
2017/0026758 A1* 1/2017 Wen ..... H04R 17/00

* cited by examiner

*Primary Examiner* — Matthew Eason
(74) *Attorney, Agent, or Firm* — Muncy, Geissler, Olds & Lowe, P.C.

(57) ABSTRACT

A piezoelectric ceramic speaker includes a conductive plate and a round piezoelectric ceramic sheet. The conductive plate has notches and sound delivering holes. The round piezoelectric ceramic plate is stacked on a central region of the conductive plate. The notches are opened on a periphery region of the conductive plate and partly extended toward the central region. The notches are equiangularly arranged on the conductive plate with respect to the center of the conductive plate. Accordingly, auxiliary fixtures can pass through the notches to position the conductive plate. Hence, the conductive plate can be positioned by the fixtures during manufacturing processes. Consequently, the piezoelectric ceramic speaker can be mass produced with good yield rates. Additionally, since the round piezoelectric ceramic plate and the conductive plate are coaxially arranged, a dual-band earphone having the piezoelectric ceramic speaker can provide a better sound resolution performance.

11 Claims, 7 Drawing Sheets

PIEZOELECTRIC CERAMIC SPEAKER AND DUAL-BAND EARPHONE HAVING THEREOF

CROSS-REFERENCES TO RELATED APPLICATIONS

This non-provisional application claims priority under 35 U.S.C. §119(a) on patent Application No. 104208756 filed in Taiwan, R.O.C. on Jun. 2, 2015, the entire contents of which are hereby incorporated by reference.

BACKGROUND

Technical Field

The instant disclosure relates to a piezoelectric ceramic speaker and a dual-band earphone having thereof.

Related Art

Please refer to FIG. 1, which provides a top view of a traditional piezoelectric ceramic speaker 100. The piezoelectric ceramic speaker 100 includes a conductive plate 110 and a ceramic plate 120. A plurality of sound delivering holes 111 is opened on the conductive plate 110. The ceramic plate 120 is installed to a surface of the conductive plate 110. The piezoelectric ceramic speaker 100 is assembled in a housing of an earphone and provided as a high-pitched speaker.

The ceramic plate 120 is designated to be of rectangular shape, so that the ceramic plate 120 can be manufactured by simple cutting process. However, the conductive plate 110 is of round shape. Therefore, in sound generation, the vibrations of the conductive plate 110 and the ceramic plate 120 are not uniform, parts of the vibrational energies of the conductive plate 110 and the ceramic plate 120 would be cancelled out by each other, and the sound distortion might occur easily.

Besides, since the conductive plate 110 and the ceramic plate 120 have different shapes, the difficulty in machine manufactory of the piezoelectric ceramic speakers 100 increases. Therefore, the piezoelectric ceramic speaker 100 has to be assembled manually. In addition, when forming the sound delivering holes 111, the sound delivering holes 111 might be formed on the conductive plate 110 with an offset from their predefined forming positions. Sometimes, forming the sound delivering holes 111 might make the conductive plate 110 uneven. Accordingly, the yield rate of the piezoelectric ceramic speaker 110 is reduced and it is hard to mass production by automatic machines.

SUMMARY

To address these issues, an embodiment of the instant disclosure provides a piezoelectric ceramic speaker. The piezoelectric ceramic speaker comprises a conductive plate, a round piezoelectric ceramic plate, at least two sound delivering holes, and at least two notches. The conductive plate has a central region and a peripheral region. The central region and the conductive plate are concentrically arranged. The round piezoelectric ceramic plate is stacked on the central region. The central region and the round piezoelectric ceramic plate are coaxially arranged. The notches are opened on the peripheral region and partly extended toward the central region, respectively. The notches are equiangularly arranged on the conductive plate with respect to the center of the conductive plate.

In one embodiment, the sound delivering holes are equiangularly arranged on the conductive plate with respect to the center of the conductive plate. In another embodiment, the sound delivering holes are arranged into pairs, and the paired sound delivering holes are arranged on the conductive plate with respect to the center of the conductive plate. The notches may be of round, oblong, rectangular, fan, ellipse, arc shape, or combinations thereof. The sound delivering holes may be of round shape, oblong shape, rectangular shape, fan-shaped shape, elliptical shape, arc shape, or combinations thereof.

Another embodiment of the instant disclosure provides a dual-band earphone having a piezoelectric ceramic speaker. The dual-band earphone comprises a housing, a piezoelectric speaker, and a low-pitched speaker. The housing has a sound output portion. The piezoelectric ceramic speaker is assembled in the housing, adapted to generate a high frequency sound signal, and facing toward the sound output portion. The piezoelectric ceramic speaker comprises a conductive plate, a round piezoelectric ceramic plate, at least two sound delivering holes, and at least two notches. The conductive plate has a central region and a peripheral region. The central region and the conductive plate are concentrically arranged. The round piezoelectric ceramic plate is stacked on the central region. The central region and the round piezoelectric ceramic plate are coaxially arranged. The notches are opened on the peripheral region and partly extended toward the central region, respectively. The notches are equiangularly arranged on the conductive plate with respect to the center of the conductive plate. The low-pitched speaker is assembled in the housing and adapted to generate a low frequency sound signal. The low frequency sound signal is delivered to the sound output portion through the sound delivering holes.

In one embodiment, the housing further comprises a bracket therein, and the bracket is combined with the piezoelectric ceramic speaker and the low-pitched speaker.

Specifically, the conductive plate may further comprise a positioning groove, such that the conductive plate is engaged with the housing or the bracket by the positioning groove. Particularly, the conductive plate may further comprise an orientated positioning groove, such that the conductive plate is engaged with the housing or the bracket by the orientated positioning groove with a specific orientation.

In one embodiment, the conductive plate is further connected to a conductive member. The conductive member is connected to one side of the conductive plate and electrically connected to the low-pitched speaker.

In one embodiment, the low frequency sound signal is further delivered to the sound output portion through the notches.

Based on the above, the notches allow the conductive plate to be positioned and fixed during manufacturing processes. Hence, during forming the sound delivering holes on the conductive plate or during gluing the round piezoelectric ceramic plate onto the conductive plate, the conductive plate can be properly positioned by the fixtures. Therefore, the sound delivering holes can be formed at their predefined forming positions because the conductive plate is not moved or rotated during manufacturing process. Consequently, the piezoelectric ceramic speaker can be manufactured in a mass production manner by machinery art, and the yield rate of the piezoelectric ceramic speaker can be improved.

Additionally, since the round piezoelectric ceramic plate and the conductive plate are coaxially arranged, the round piezoelectric ceramic plate and the conductive plate 10 can vibrate simultaneously so as to reduce the cancel-out phenomenon and the sound distortion. Therefore, the dual-band earphone having the piezoelectric ceramic speaker can provide a better sound resolution performance to a user.

Detailed description of the characteristics and the advantages of the disclosure is shown in the following embodiments, the technical content and the implementation of the disclosure should be readily apparent to any person skilled in the art from the detailed description, and the purposes and the advantages of the disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
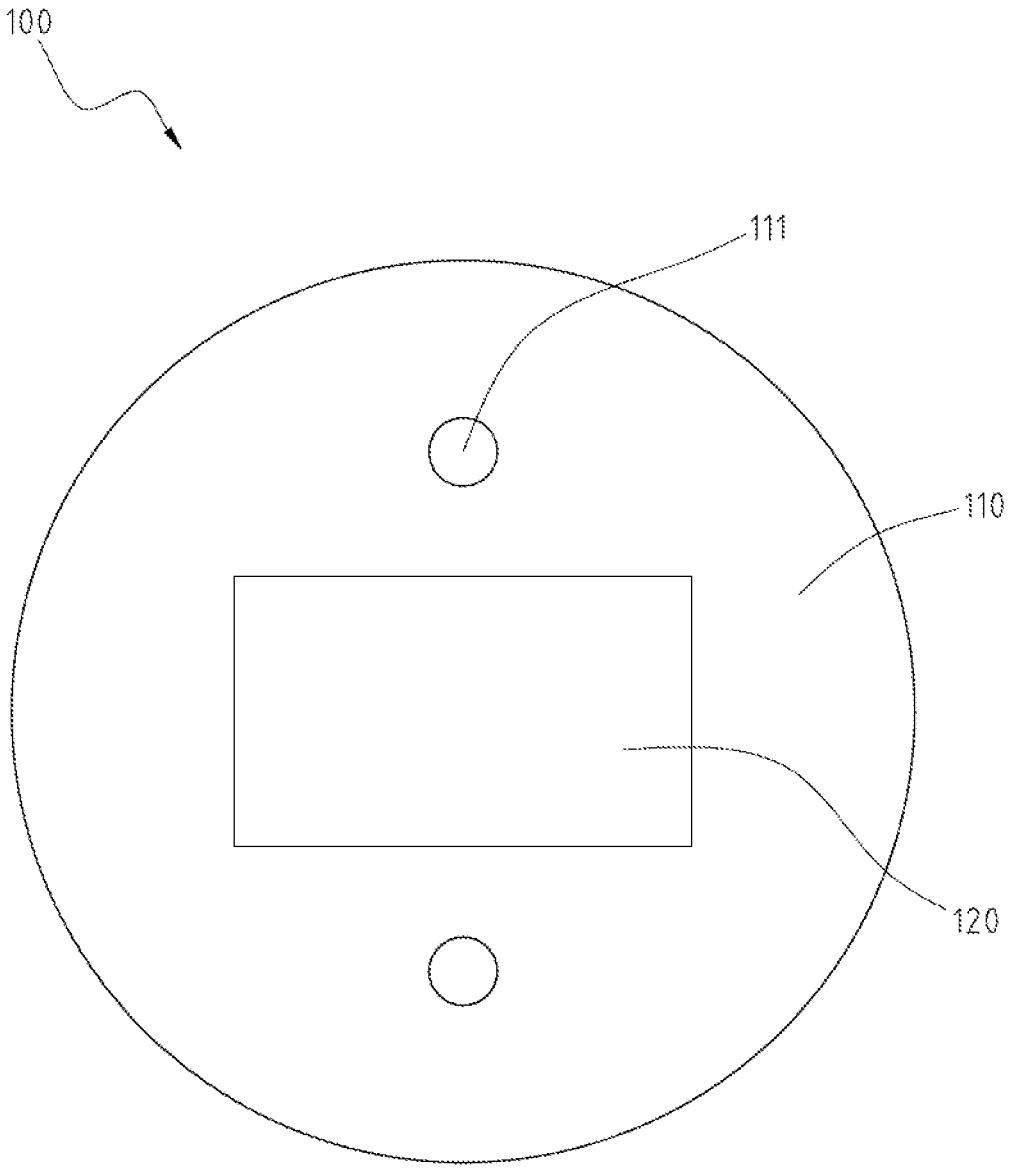
Fig. 1 (Prior art)
FIG. 1 is a top view of a traditional piezoelectric ceramic speaker.
Figure 2A:
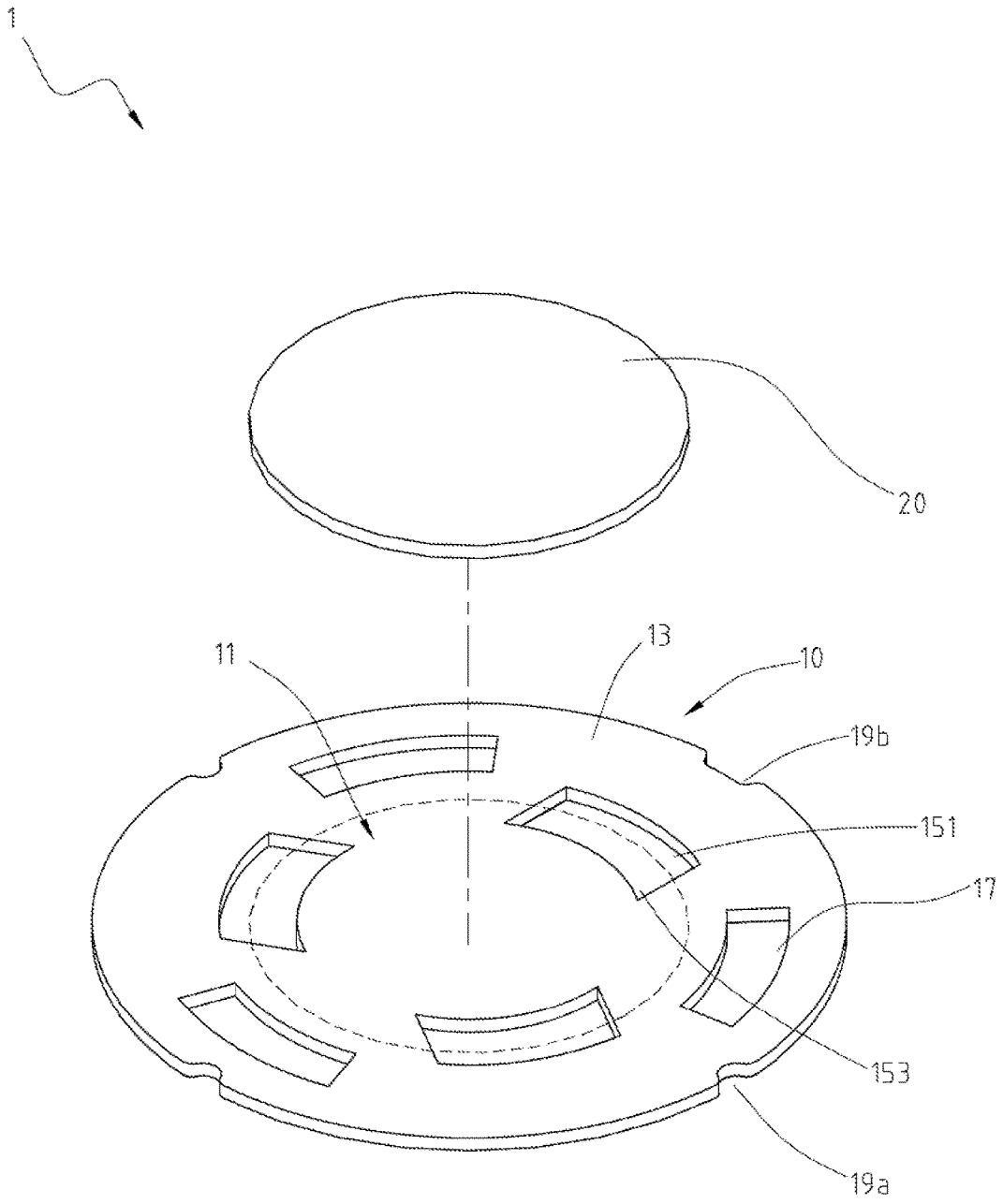
FIG. 2A is an exploded view of a piezoelectric ceramic speaker according to a first embodiment of the instant disclosure.
Figure 2B:
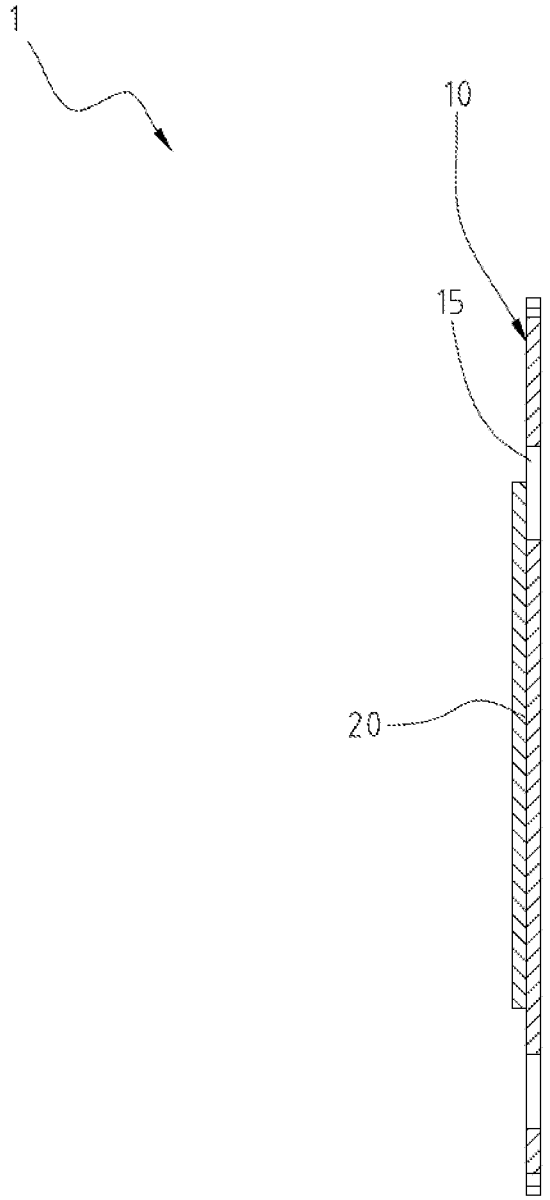
FIG. 2B is a sectional view of the piezoelectric ceramic speaker of the first embodiment.

Please refer to FIGS. 2A and 2B, which provide an exploded view and a sectional view of a piezoelectric ceramic speaker 1 according to a first embodiment of the instant disclosure. As shown in FIGS. 2A and 2B, the piezoelectric ceramic speaker 1 comprises a conductive plate 10 and a round piezoelectric ceramic plate 20. The conductive plate 10 has a central region 11 and a peripheral region 13. The central region 11 and the conductive plate 10 are concentrically arranged. In other words, the central region 11 and the conductive plate 10 share the same center. The peripheral region 13 is located around the central region 11, and at least two sound delivering holes 17 are opened on the peripheral region 13. At least two notches 15 are further opened on the conductive plate 10. Each of the notches 15 has a first portion 151 and a second portion 153, the first portion 151 is located at the peripheral region 13, and the second portion 153 is located at the central region 11. The notches 15 are equiangularly arranged on the conductive plate 10 with respect to the center of the conductive plate 10, i.e. the notches 15 are configured on the conductive plate 10 by a point-symmetrical manner with respect to the center of the conductive plate 10.

The round piezoelectric ceramic plate 20 is stacked on the central region 11 of the conductive plate 10. Moreover, as shown in FIG. 2A, a periphery of the round piezoelectric ceramic plate 20 is stacked and matched on a periphery of the central region 11 in a vertical projecting direction. The round piezoelectric ceramic plate 20 may be glued and fixed on the conductive plate 10. The round piezoelectric ceramic plate 20 shields the second portions 153 of the notches 15, and the conductive plate 10 and the round piezoelectric ceramic plate 20 are coaxially arranged. In the first embodiment, the conductive plate 20 is approximately of round shape and the notches 15 are fan-shaped shape, opened on the peripheral region 13 and partly extended toward the central region 11, respectively.

In the first embodiment, the conductive plate 10 is uniformly divided into three parts, with each part of 120 degree, the notches 15 are equiangularly arranged on the conductive plate 10 with respect to the center of the conductive plate 10, and the notches 15 are respectively located at the three parts of the conductive plate 10. That is, the notches 15 are configured on the conductive plate 10 by a point-symmetrical manner with respect to the center of the conductive plate 10. In addition, the sound delivering holes 17 are fan-shaped shape, and the sound delivering holes 17 are equiangularly arranged on the peripheral region 13 of the conductive plate 10 with respect to the center of the conductive plate 10. That is, the sound delivering holes 17 are configured on peripheral region 13 of the conductive plate 10 by a point-symmetrical manner with respect to the center of the conductive plate 10.

Figure 3A:
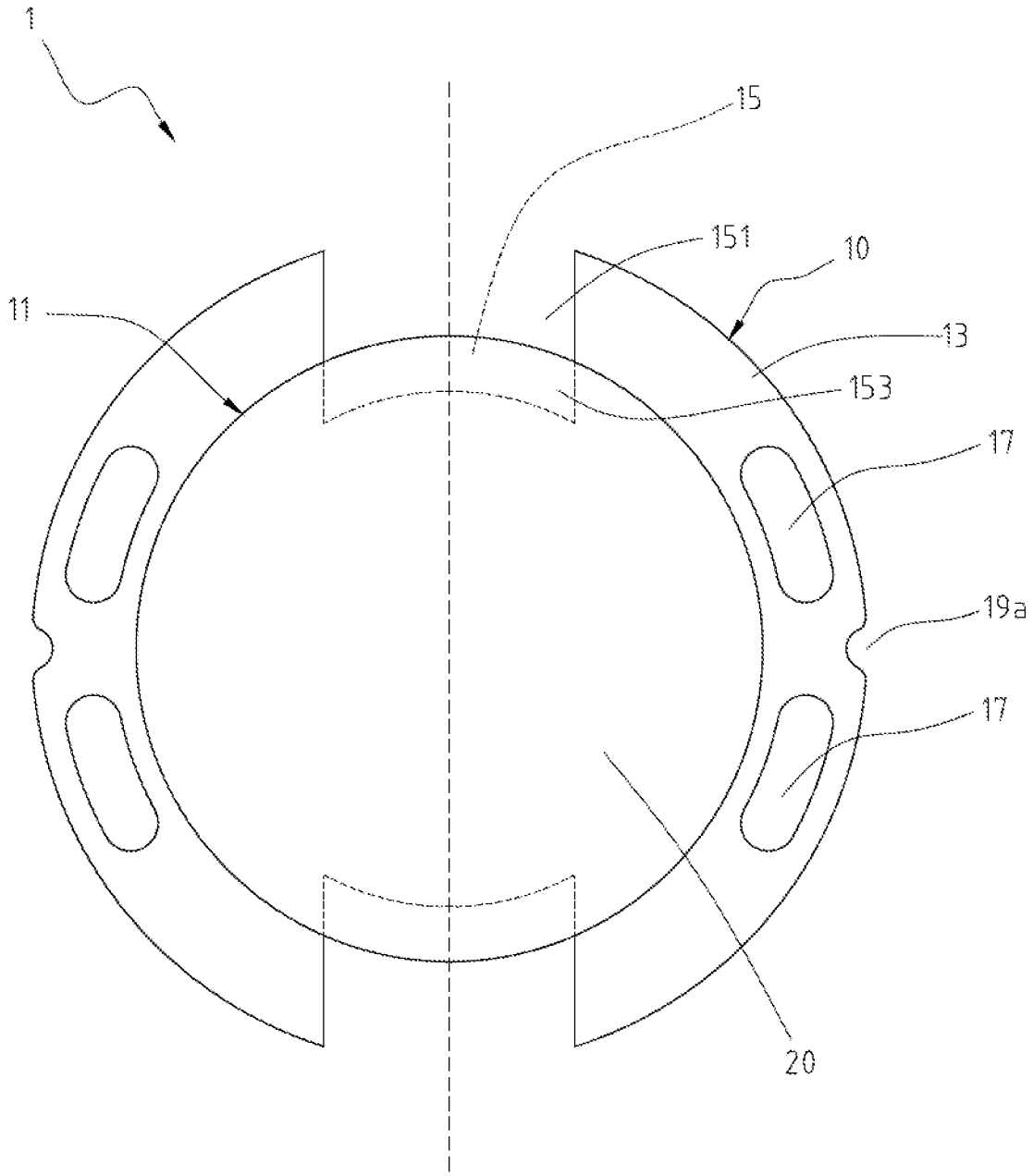
FIG. 3A is a top view of a piezoelectric ceramic speaker according to a second embodiment of the instant disclosure.
Figure 3B:
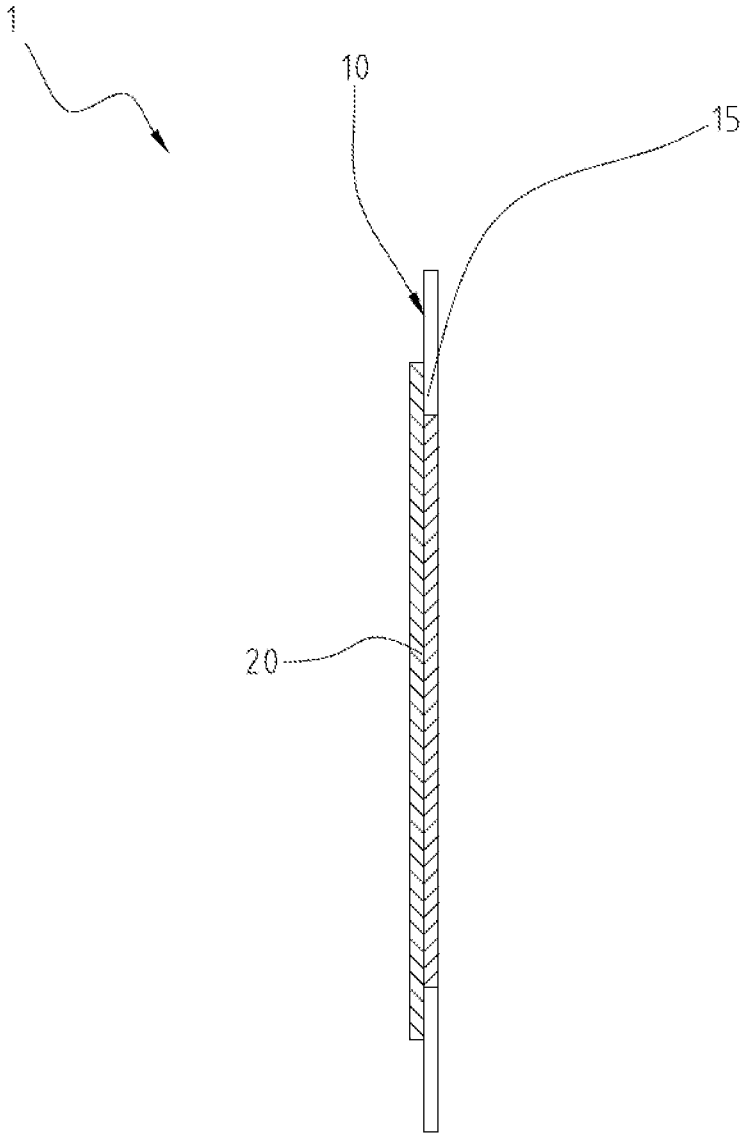
FIG. 3B is a sectional view of the piezoelectric ceramic speaker of the second embodiment.

Please refer to FIGS. 3A to 3B, which provide a top view and a sectional view of a piezoelectric ceramic speaker 1 according to a second embodiment of the instant disclosure. As shown in FIGS. 3A and 3B, the piezoelectric ceramic speaker 1 comprises a conductive plate 10 and a round piezoelectric ceramic plate 20. In the second embodiment, the conductive plate 10 is approximately of round shape. The structure of the second embodiment is approximately the same as that of the first embodiment, except that in the second embodiment, the conductive plate 10 is uniformly divided into two parts, with each part of 180 degree. The notches 15 are fan-shaped shape, equiangularly arranged on the conductive plate 10 with respect to the center of the conductive plate 10, and opposite with each other. That is, the notches 15 are configured on the conductive plate 10 by a point-symmetrical manner with respect to the center of the conductive plate 10. In the second embodiment, each of the notches 15 is a cut formed on the peripheral region 13. Besides, the sound delivering holes 17 are of oblong shape and arranged into pairs. The paired sound delivering holes 17 are arranged on the conductive plate 10 with respect to the center of the conductive plate 10. That is, the paired sound delivering holes 17 are configured on the conductive plate 10 by a point-symmetrical manner with respect to the center of the conductive plate 10.

Figure 4:
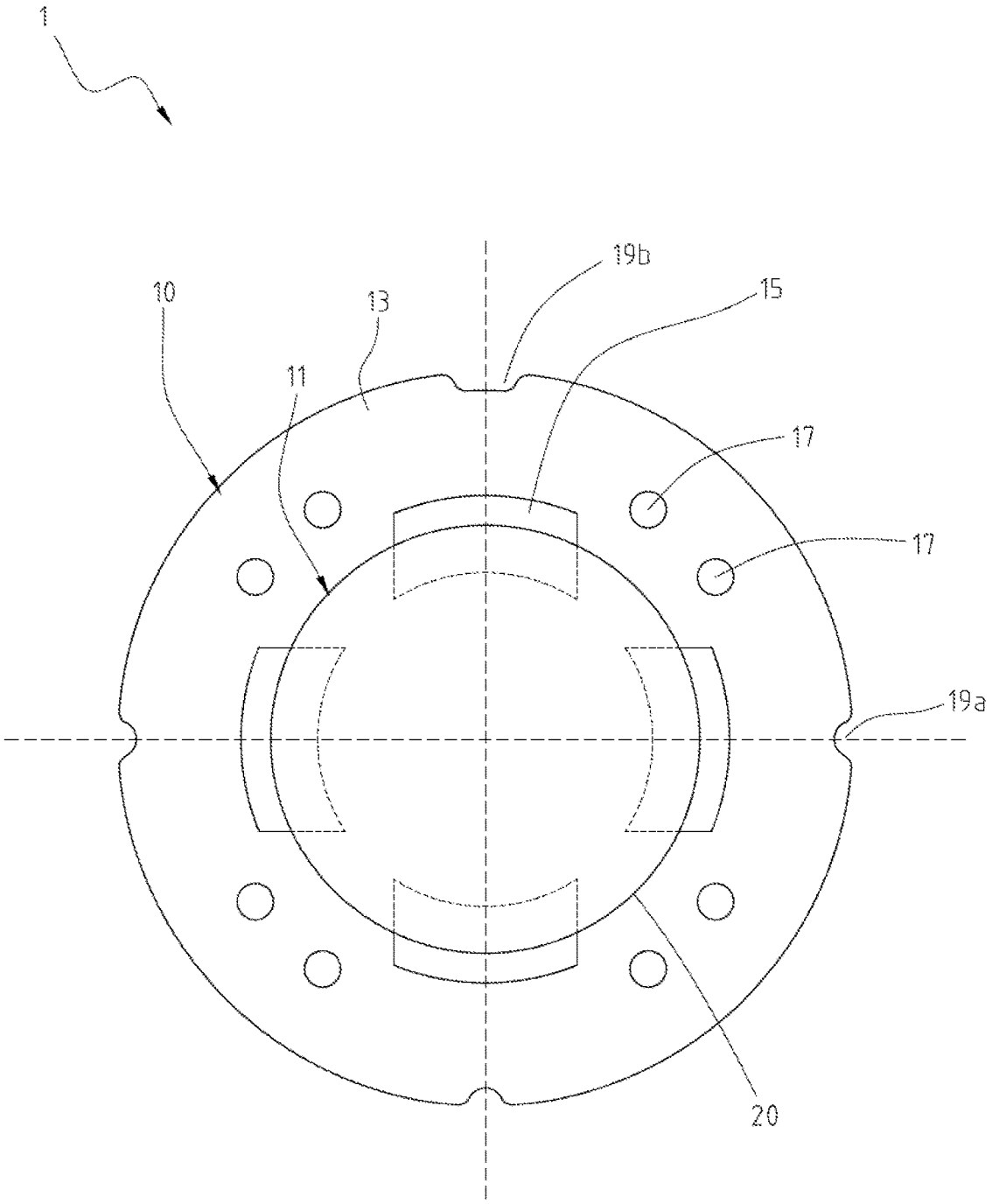
FIG. 4 is a top view of a piezoelectric ceramic speaker according to a third embodiment of the instant disclosure.

Please refer to FIG. 4, which provides a top view of a piezoelectric ceramic speaker 1 according to a third embodiment of the instant disclosure. As shown in FIG. 4, the third embodiment is a variation of the foregoing embodiments. The conductive plate 10 is approximately of round shape. The structure of the third embodiment is approximately the same as that of the first embodiment, except that in the third embodiment, the conductive plate 10 is uniformly divided into four parts, with each part of 90 degree. The notches 15 are fan-shaped shape and equiangularly arranged on the conductive plate 10 with respect to the center of the conductive plate 10. Besides, the sound delivering holes 17 are of round shape and arranged into pairs. The paired sound delivering holes 17 are arranged on the conductive plate 10 with respect to the center of the conductive plate 10. Specifically, as shown in FIG. 2A, FIG. 3A, and FIG. 4, the conductive plate 10 further comprises at least one positioning groove 19*a* formed on the edge thereof. The positioning groove 19*a* is provided for engaging the conductive plate 10 with a housing of an earphone. Particularly, the conductive plate 10 further comprises at least one orientated positioning groove 19*b* formed on the edge thereof. The orientated positioning groove 19*b* has a different shape from the positioning groove 19*a* and is provided for engaging the conductive plate 10 with the housing of the earphone with a specific orientation.

Each of the notches 15 may be of round shape, oblong shape, rectangular shape, fan-shaped shape, elliptical shape, arc shape, or combinations thereof. Specifically, the "combinations thereof" means any combinations of the foregoing six shapes, for example, the notches 15 may be of any two of, three of, four or more of the shapes. Each of the sound delivering holes 17 is of round shape, oblong shape, rectangular shape, fan-shaped shape, elliptical shape, arc shape, or combination thereof. Specifically, the "combinations thereof" means any combinations of the foregoing six shapes, for example, the sound delivering holes 17 may be of any two of, three of, four or more of the shapes. The structure of the notches 15 and that of the sound delivering holes 17 depicted in the embodiments are provided as illustrative purposes. In practice, the number, the shape, the arrangement of the notches 15 and the sound delivering holes 17 can be adjusted according to different requirements.

Figure 5:
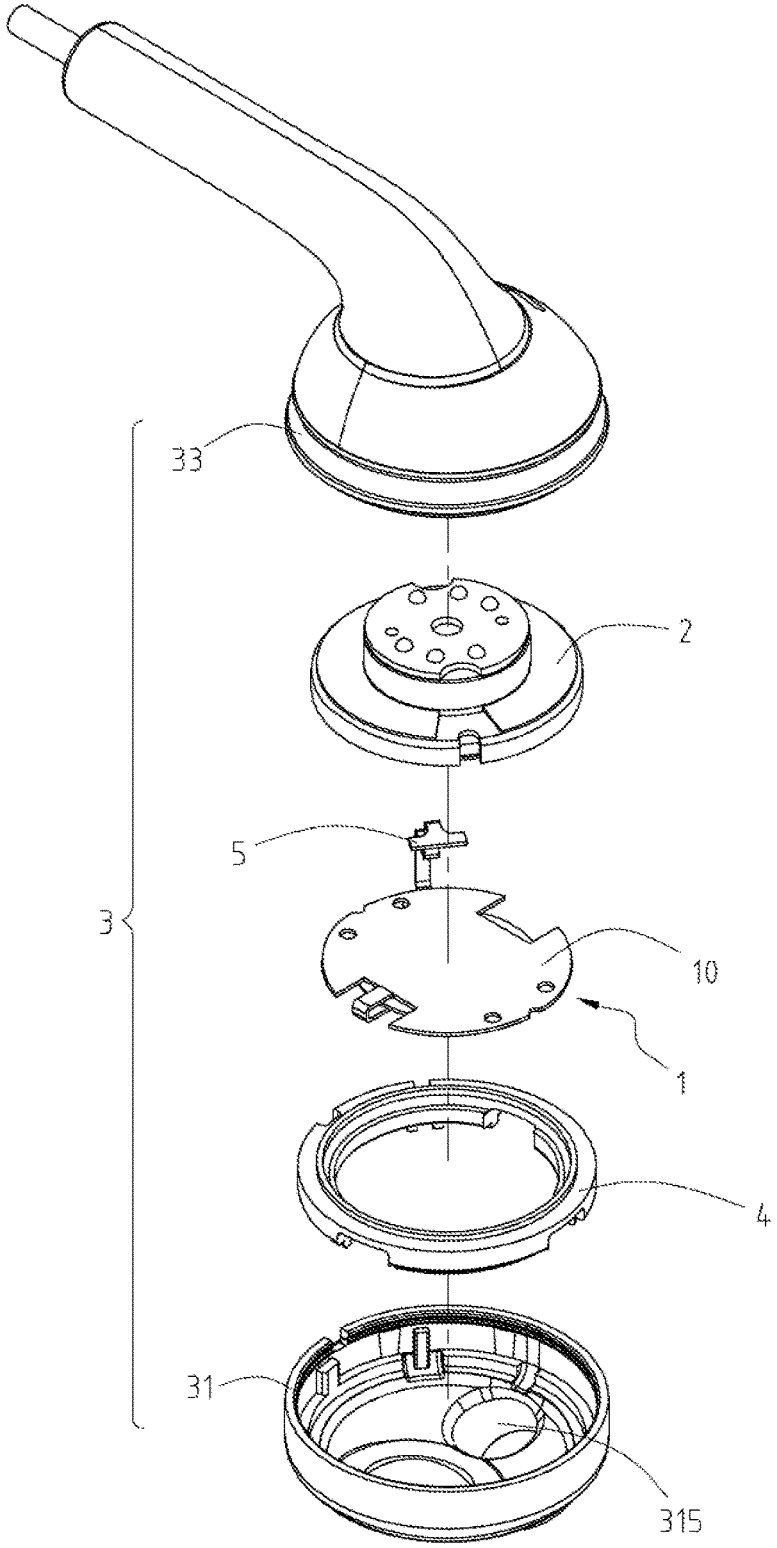
FIG. 5 is an exploded view of a dual-band earphone having a piezoelectric ceramic speaker according to an exemplary embodiment of the instant disclosure.

Please refer to FIG. 5, which provides an exploded view of a dual-band earphone having a piezoelectric ceramic speaker, according to an exemplary embodiment of the instant disclosure. The dual-band earphone comprises a piezoelectric ceramic speaker 1, a low-pitched speaker 2, and a housing 3. The housing 3 comprises a front cover 31 and a rear cover 33 assembled with the front cover 31. The front cover 31 has a sound output portion 315. The low-pitched speaker 2 is assembled in the housing 3, and a sound output direction of the low-pitched speaker 2 faces toward the sound output portion 315. The piezoelectric ceramic speaker 1 is assembled in the housing 3 and faces toward the sound output portion 315. The low-pitched speaker 2 generates a low frequency sound signal, and the low frequency sound signal is delivered to the sound output portion 315 through the sound delivering holes 17 of the piezoelectric ceramic speaker 1. In addition, the low frequency sound signal may be delivered to the sound output portion 315 through the notches 15.

The housing 3 further comprises a bracket 4 therein. The bracket 4 is assembled to the front cover 31 or the rear cover 33. The piezoelectric ceramic speaker 1 and the low-pitched speaker 2 are assembled to the bracket 4 so as to be fixedly assembled in the housing 3. Specifically, the piezoelectric ceramic speaker 1 and the low-pitched speaker 2 may be respectively assembled to two sides of the bracket 4. Please refer to FIG. 2A, FIG. 3A, and FIG. 4, the positioning groove 19*a* or the orientated positioning groove 19*b* of the conductive plate 10 can be engaged with the bracket 4 or the housing 3, such that the conductive plate 10 is fixed and positioned with the housing 3 or the bracket 4.

In addition, the conductive plate 10 is further connected to a conductive member 5, and the conductive member 5 is connected to one side of the conductive plate 10 and connected to the low-pitched speaker 2, so that the piezoelectric ceramic speaker 1 is electrically connected to the low-pitched speaker 2.

The piezoelectric ceramic speaker 1 depicted in the foregoing embodiments is to solve the insufficient positioning of the traditional piezoelectric ceramic speaker. Auxiliary fixtures are provided to pass through the notches 15, such that the conductive plate 10 can be positioned and fixed by the fixtures. Hence, during forming the sound delivering holes 17 on the conductive plate 10 or during gluing the round piezoelectric ceramic plate 20 onto the conductive plate 10, the conductive plate 10 can be properly positioned by the fixtures. Therefore, the sound delivering holes 17 can be formed at their predefined forming positions because the conductive plate 10 is not moved or rotated during manufacturing process. Consequently, the piezoelectric ceramic speaker 1 can be manufactured in a mass production manner, and the yield rate of the piezoelectric ceramic speaker 1 can be improved.

Additionally, since the round piezoelectric ceramic plate 20 and the conductive plate 10 are coaxially arranged, the round piezoelectric ceramic plate 20 and the conductive plate 10 can vibrate simultaneously so as to reduce the cancel-out phenomenon and the sound distortion. Therefore, the dual-band earphone having the piezoelectric ceramic speaker can provide a better sound resolution performance to a user.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A piezoelectric ceramic speaker, comprising:

a conductive plate having a central region and a peripheral region, wherein the central region and the conductive plate are concentrically arranged;

a round piezoelectric ceramic plate stacked on the central region, wherein the central region and the round piezoelectric ceramic plate are coaxially arranged, and a periphery of the round piezoelectric ceramic plate is stacked and matched on a periphery of the central region in a vertical projecting direction;

at least two sound delivering holes opened on the peripheral region; and at least two notches opened on the peripheral region and partly extended toward the central region, respectively, wherein the notches are equiangularly arranged on the conductive plate with respect to the center of the conductive plate.

2. The piezoelectric ceramic speaker according to claim 1, wherein the sound delivering holes are equiangularly arranged on the conductive plate with respect to the center of the conductive plate.

3. The piezoelectric ceramic speaker according to claim 1, wherein the sound delivering holes are arranged into pairs, and the paired sound delivering holes are arranged on the conductive plate with respect to the center of the conductive plate.

4. The piezoelectric ceramic speaker according to claim 1, wherein each of the notches is of round shape, oblong shape, rectangular shape, fan-shaped shape, elliptical shape, arc shape, or combinations thereof.

5. The piezoelectric ceramic speaker according to claim 1, where each of the sound delivering holes is of round shape, oblong shape, rectangular shape, fan-shaped shape, elliptical shape, arc shape, or combinations thereof.

6. A dual-band earphone having a piezoelectric ceramic speaker, comprising:

a housing having a sound output portion;

a piezoelectric ceramic speaker, assembled in the housing, adapted to generate a high frequency sound signal, and facing toward the sound output portion, wherein the piezoelectric ceramic speaker comprises:

a conductive plate having a central region and a peripheral region, wherein the central region and the conductive plate are concentrically arranged;

a round piezoelectric ceramic plate stacked on the central region, wherein the central region and the round piezoelectric ceramic plate are coaxially arranged, and a periphery of the round piezoelectric ceramic plate is stacked and matched on a periphery of the central region in a vertical projecting direction;

at least two sound delivering holes opened on the peripheral region; and at least two notches opened on the peripheral region and partly extended toward the central region, respectively, wherein the notches are equiangularly arranged on the conductive plate with respect to the center of the conductive plate; and a low-pitched speaker assembled in the housing and adapted to generate a low frequency sound signal, wherein the low frequency sound signal is delivered to the sound output portion through the sound delivering holes.

7. The dual-band earphone according to claim 6, wherein the housing further comprises a bracket therein, and the bracket is combined with the piezoelectric ceramic speaker and the low-pitched speaker.

8. The dual-band earphone according to claim 7, wherein the conductive plate further comprises a positioning groove, such that the conductive plate is engaged with the housing or the bracket by the positioning groove.

9. The dual-band earphone according to claim 8, wherein the conductive plate further comprises an orientated positioning groove, wherein the orientated positioning groove has a different shape from the positioning groove, such that the conductive plate is engaged with the housing or the bracket by the orientated positioning groove with a specific orientation.

10. The dual-band earphone according to claim 6, wherein the conductive plate is further connected to a conductive member, wherein the conductive member is connected to one side of the conductive plate and electrically connected to the low-pitched speaker.

11. The dual-band earphone according to claim 6, wherein the low frequency sound signal is further delivered to the sound output portion through the notches.

* * * * *